US006085511A

United States Patent [19]

Dinkelmann et al.

[11] Patent Number: 6,085,511

[45] Date of Patent: Jul. 11, 2000

[54] UNDERWINDING-THREAD CLAMP FOR A RING-SPINNING OR RING-TWISTING MACHINE

[75] Inventors: Friedrich Dinkelmann, Rechberghausen; Peter Mann, Süssen, both of Germany

[73] Assignee: Zinser Textilmaschinen GmbH, Ebersbach Fils, Germany

[21] Appl. No.: 09/289,437

[22] Filed: Apr. 9, 1999

[30] Foreign Application Priority Data

Apr. 9, 1998 [DE] Germany ..... 198 16 205
Mar. 8, 1999 [DE] Germany ..... 199 10 072

[51] Int. Cl.[7] ..... D01H 7/08

[52] U.S. Cl. ..... 57/135; 57/299; 57/75; 57/131; 57/300; 242/473.8; 242/473.7

[58] Field of Search ..... 57/75, 131, 129, 57/135, 261, 269, 278, 279, 299, 300; 242/473.7, 473.8, 487.6, 474.2

[56] References Cited

U.S. PATENT DOCUMENTS 652,725 6/1900 Roney ..... 57/131
2,428,081 9/1947 Keight et al. ..... 57/75
2,432,564 12/1947 Elvin ..... 57/75
4,617,791 10/1986 Lousberg ..... 57/299
4,796,422 1/1989 Odawara ..... 57/299

FOREIGN PATENT DOCUMENTS 0 292 856 5/1988 European Pat. Off. .
0 358 032 3/1990 European Pat. Off. .
0 462 467 12/1991 European Pat. Off. .
0 587 526 3/1994 European Pat. Off. .
0 775 769 5/1997 European Pat. Off. .
29 31 209 5/1989 Germany .
91 11 455 12/1991 Germany .
196 28 826 1/1998 Germany .

*Primary Examiner*—John J. Calvert
*Assistant Examiner*—Mary K. Fiore
*Attorney, Agent, or Firm*—Herbert Dubno

[57] ABSTRACT

An underwinding thread clamp for a spindle of a ring spinning or ring-twisting machine has a clamping sleeve biased by a spring against and juxtaposed with a collar on the spindle. The juxtaposed surfaces of the spindle and collar have wavy contours so that, upon engagement of an actuating member with each collar, the latter is cammed into its open position to release the respective underwinding thread so that the latter, engaged when a full bobbin was removed, can be released. The clamping of the underwinding thread permits the thread to be wound on the newly mounted core sleeve.

16 Claims, 8 Drawing Sheets

UNDERWINDING-THREAD CLAMP FOR A RING-SPINNING OR RING-TWISTING MACHINE

FIELD OF THE INVENTION

The present invention relates to the clamping of an underwinding thread on the spindle of a ring-spinning or ring-twisting machine. More particularly this invention relates to ring spinning and ring-twisting machines having a row of spindles which can be associated with respective traveller rings and from the travellers of which the yarn is wound in a bobbin or yarn package on the spindle and wherein the full bobbins are withdrawn from the spindles. The invention is directed especially to the clamping of an underwinding thread, i.e. a thread which is wound below the yarn package and is held on the spindle so that, when the yarn package is removed, the thread is broken to separate the underwinding thread from the yarn package and, as a consequence, the underwinding thread remains available when the yarn is to be wound on a new bobbin sleeve or core. The invention, in more specific terms, relates to the clamping of the underwinding thread beneath the yarn package and in such manner that the underwinding thread forms a loop of less than 360° to avoid accumulating a significant reserve of the tail thread or underwinding thread beneath the bobbin.

BACKGROUND OF THE INVENTION

Especially in ring-spinning machines and ring-twisting machines in which the yarn or thread arrives from a drafting frame, passes through a traveller orbiting on a ring around a spindle and winds the yarn or thread in a yarn package or bobbin on a core sleeve or tube on the spindle, and an automatic bobbin change mechanism is provided for removing a fully wound bobbin from the spindle and replacing it with an empty core sleeve, it has been desirable to wind the tail thread, i.e. the thread length or yarn length coming from the traveller following the last bobbin winding, on the spindle below the bobbin.

As soon as the ring-spinning or ring-twisting operation is complete and the bobbin fully wound, the spinning is usually terminated and a cover thread or yarn, a reserve thread or yarn and an unwinding can be formed. The formation of the underwinding in a number of turns below the underwinding crown in a milled or knurled region of the whorl of the spindle is common.

As a result, a number of turns of thread accumulate on the knurled or milled region since, with the doffing of each full bobbin, the unwinding thread is broken away from the bobbin thread and remains on the spindle after the new core tube is mounted and winding of a bobbin is begun again.

In automatically doffing systems of this type, it has been necessary from time to time to remove the turns of the underwinding thread which have accumulated and this can be achieved by manually operating a device for removing the underwinding (see German Patent Document DE 29 31 209) or through the use of an automatic cleaning element (see German Patent Document G 91 11 455.1).

The removal of the accumulated underwindings must be carried out in conjunction with evacuation of the lint and underwinding thread particles which are cut away to avoid the entrapment of the line or yarn particles in the yarn which is being wound up on the same station or at the other spindle stations of the ring spinning or ring twisting machine.

Systems involve evacuation of lint, dust and scraps of yarn and collecting these materials as they are drawn off by suction have high capital cost and take up considerable space on the machine. This is also true for the device or devices which actually cut away the turns of the underwinding which have accumulated.

In recent years systems have been developed which avoid these disadvantages by minimizing the amount of underwinding that can accumulate on a spindle or by eliminating the accumulation of underwindings altogether.

This can be achieved by providing a clamp beneath the bobbin or yarn package which can engage the underwinding thread or yarn so that full turns or multiple turns of an unwinding need not accumulate. When the unwinding is present in a loop of less than 360°, for example, the release of the clamp can release the unwinding during the subsequent bobbin winding operation so that there is no accumulation of yarn or thread on the spindle which must be cleared away with the complications enumerated above.

For example, a clamping system for this purpose is described in EP 0 292 856 A1 which relies upon centrifugal force. A clamping gap is opened and in the terminal spinning operations, enables a partial turn of the unwinding to be clamped and later released. To reset the clamping body during the terminal stages of spinning into a clamping position, a restoring element, e.g. an annular spring can be used in another construction (see EP 0 358 032 A1).

An actuating element can operate on an axially shiftable clamping sleeve in EP 0 462 467 B1 which can be moved between working and open positions in a restoring element, for example a spring which acts in a direction parallel to the longitudinal axis of the spindle shaft is here used.

Still another construction utilizing the actuation of a sleeve is described for a ring-spinning or twisting machine in EP 0 587 526 A1 and here the actuating member can provide independent operation of the respective sleeve and is actuatable via a slide arrangement. The sleeves can be operated independently of the parameters of the spinning program, especially the spindle speed, or in dependence upon the spinning program. The restoring member can be a coil spring. Another clamping system is described in EP 0 775 769 A1 for clamping the underwinding thread of a spindle and provides an axially displaceable member on the spindle which can bring a clamping sleeve into engagement with the underwinding thread against a collar of the spindle after the underwinding thread has formed a turn of less than 360°. An actuating device can be fixed on the machine and a unit is provided for holding the clamping sleeve in the clamping position independently of the actuating device.

Finally, mention may be made of the system described in DE 196 288 26 A1 which provides a clamping system for a thread on a spindle on a spinning or twisting machine and which utilizes a fixed clamping element and an axially shiftable clamping element. The shiftable clamping element has a conical inner surface which is engaged by a centrifugal element which is movable independently of the shiftable clamping element.

While these systems have been found to be effective in providing the clamping action previously described, reliability requires improvement and in many systems, the mechanism is excessively complex.

OBJECTS OF THE INVENTION

It is, therefore, the principal object of the present invention to provide an improved clamping system for spindles of a ring-spinning or ring-twisting machine which is simplified by comparison to earlier arrangements, which can more reliably engage the thread after it has formed a loop of less than 360° as an underwinding thread following completion of bobbin winding and which can be simple and reliably released after the doffing operation to allow the winding of a new bobbin.

Another object of the invention is to provide a clamping device which obviates drawbacks of earlier systems for ring twisting and ring spinning machines.

SUMMARY OF THE INVENTION

These objects and others which will become apparent hereinafter are attained in accordance with the invention by providing corresponding end faces of the collar and the clamping sleeve, which is biased by a spring element toward the collar, at least over part of their respective areas and, therefore, over part of the circumference and/or the cross section, with wave-shaped contours. The wave-shaped contours provide effective clamping of the underwinding thread during the tailing off of the spinning operation and reliably permits release of the underwinding thread by the clamp when the yarn is to be wound onto a new core sleeve.

More particularly, an underwinding thread clamp for a rotatable spindle of a ring spinning or ring twisting machine can comprise:

a collar member on the spindle below the yarn package;

a clamping sleeve member on the spindle axially juxtaposed with the collar member, the members clamping an underwinding thread between them following completion of winding of the yarn package and looping of the underwinding thread through less than 360° below the yarn package, the clamping sleeve member being rotatable on the spindle and at least one of the members being axially shiftable on the spindle the members having mutually juxtaposed surfaces with complementary and interfitting wave-shaped contours axially camming the members apart to release the underthread upon rotational braking of the clamping sleeve member relative to the spindle; and an actuatable device having brake means shiftable into engagement with the clamping sleeve member for braking rotation thereof relative to the collar member to effect camming of the members apart.

The wave-shaped contour can encompass at least a single curved region although advantageously a plurality of curved regions are provided and the wave-shaped contour can be provided in two planes with the inner plane higher or lower than the outer plane.

According to a feature of the invention, the axially shiftable clamping sleeve is movable as a function of the actuatable device. This can include a pivot lever, a cam shaft or a fixed slide-actuating arrangement.

According to a further feature of the invention, the actuating device or element can be movable along the row of spindles and can be displaced in this direction by a tractive element, e.g. a belt. It can also be provided on a clamping device, for example a travelling blower, or on a separate carriage which can actuated in some other way or can have its own power source and be self driven along the row of spindles. A storage battery can be used as the power source or voltage can be picked up by a rail for driving an electric motor with line current. Of course, the actuating elements can be displaced manually by shifting or pulling on them.

The combination of the actuating unit with a cleaning device, for example a travelling blower has been found to be especially advantageous when the cleaning device also includes a suction unit and that, of course, permits any liberated underwinding thread portions to be captured by the suction device and also permits the liberated thread to be held by a suction device in place by the new bobbin core or sleeve.

According to another feature of the invention, the wave-shaped contours are provided over an entire periphery or over a total diameter of multijuxtaposed faces of the members.

The end faces can be substantially parallel to one another in cross section and can be convex and concave toward one another in cross section.

Each end face can have an inner ring and each inner ring can have an end surface provided with the wave-shaped contour. The actuating elements, which are movable toward the clamping sleeve members can all be swingable together about a common horizontal axis or can all be shiftable together along the row of spindles. Successive actuating elements can be offset from one another angularly or in an actuation direction along the row of spindles.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
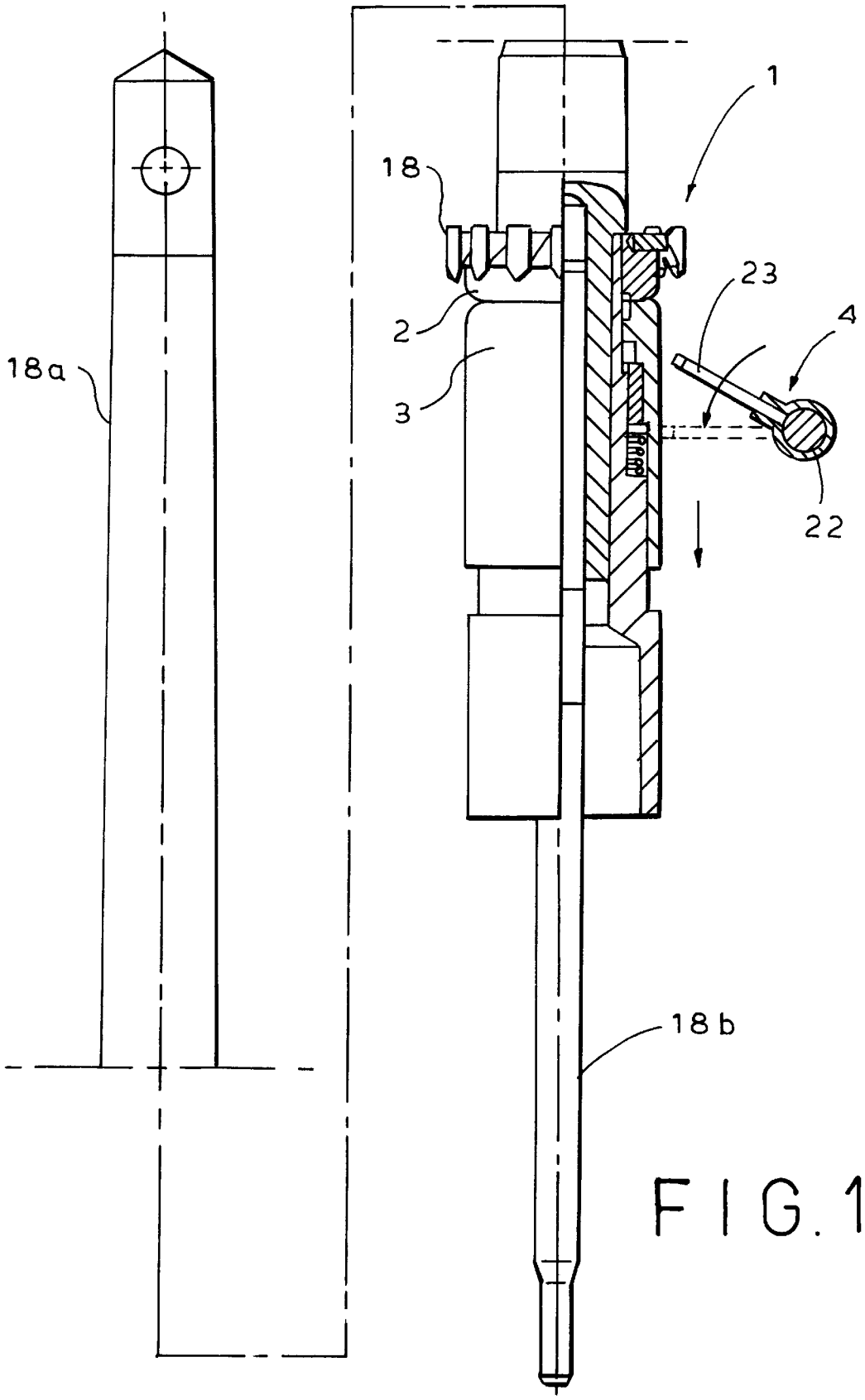
FIG. 1 is a side elevational view of a spindle for a ring-spinning or ring-twisting machine according to the invention, partly broken away.

FIG. 1 shows a side view, partly broken away, of the rotating part of a spindle 1 for a ring spinning or ring twisting frame. The spindle 1 comprises a pot blade 18 and a stem 18*a* for receiving the winding sleeve or tube, also referred to as a core tube, for a bobbin or yarn package to be wound. The spindle is also provided with a shank 18*b* allowing it to be inserted into a spindle rail and can be formed with a whorl which can be driven by an apron or belt tangentially engaging that whorl in the conventional manner.

As can best be seen from FIGS. 2*a* and 2*b*, the spindle 1 has, below the cup blade 18 a clamping sleeve 3 which is axially shiftable on the spindle and rotatable relative thereto, this clamping sleeve bearing against the collar 2 formed by the pot blade 18 and biased by a spring 5 in the direction of the collar 2. This clamping sleeve 3 is engageable by an actuating device 4 which can comprise a bar 23 mounted upon a horizontal rotatable shaft 22.

Figure 5:
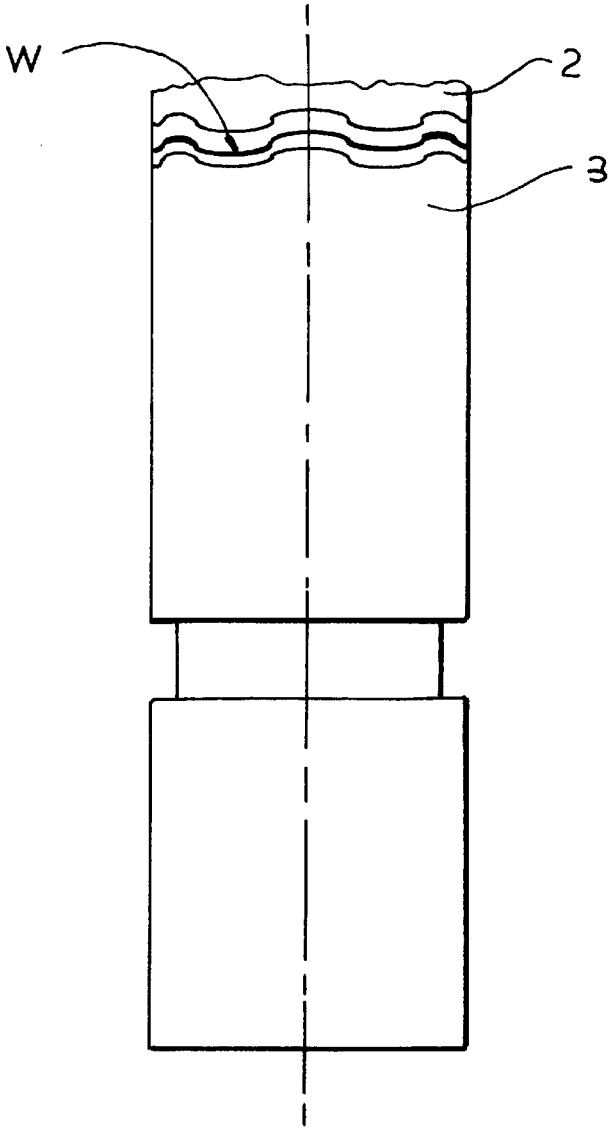
FIG. 5 is a side elevational view of a clamping unit according to the invention.

In the embodiment of FIGS. 2*a*, 2*b* and 3*a*, 3*b*, the mutually juxtaposed end faces 10 and 20 of the collar 2 and the clamping sleeve 3 have wave-shaped contours W shown in greater detail in FIG. 5 and widening toward the edge. The wave-shaped contours W can, of course, be provided only over part of the end faces along the circumference or extending along the diameter or both.

Figure 2B:
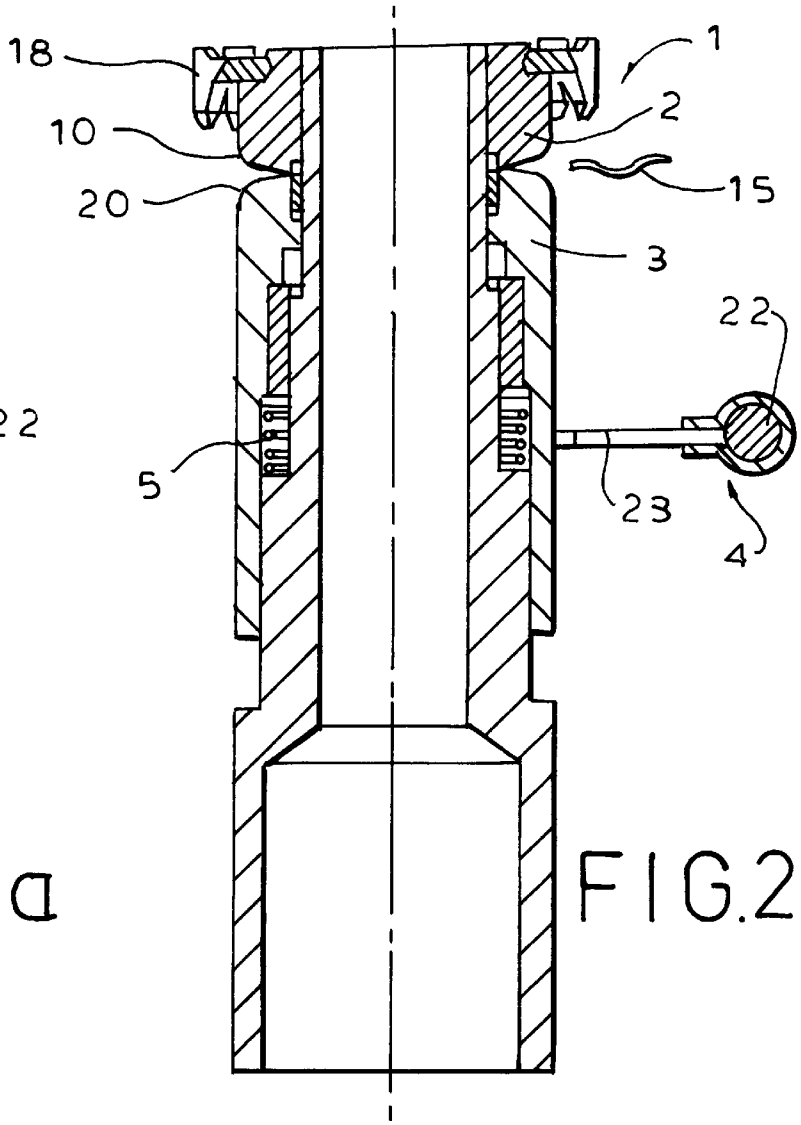
FIG. 2*b* is a view similar to FIG. 2*a* but showing the parts thereof in the position in which an underwinding thread is released.
Figure 2A:
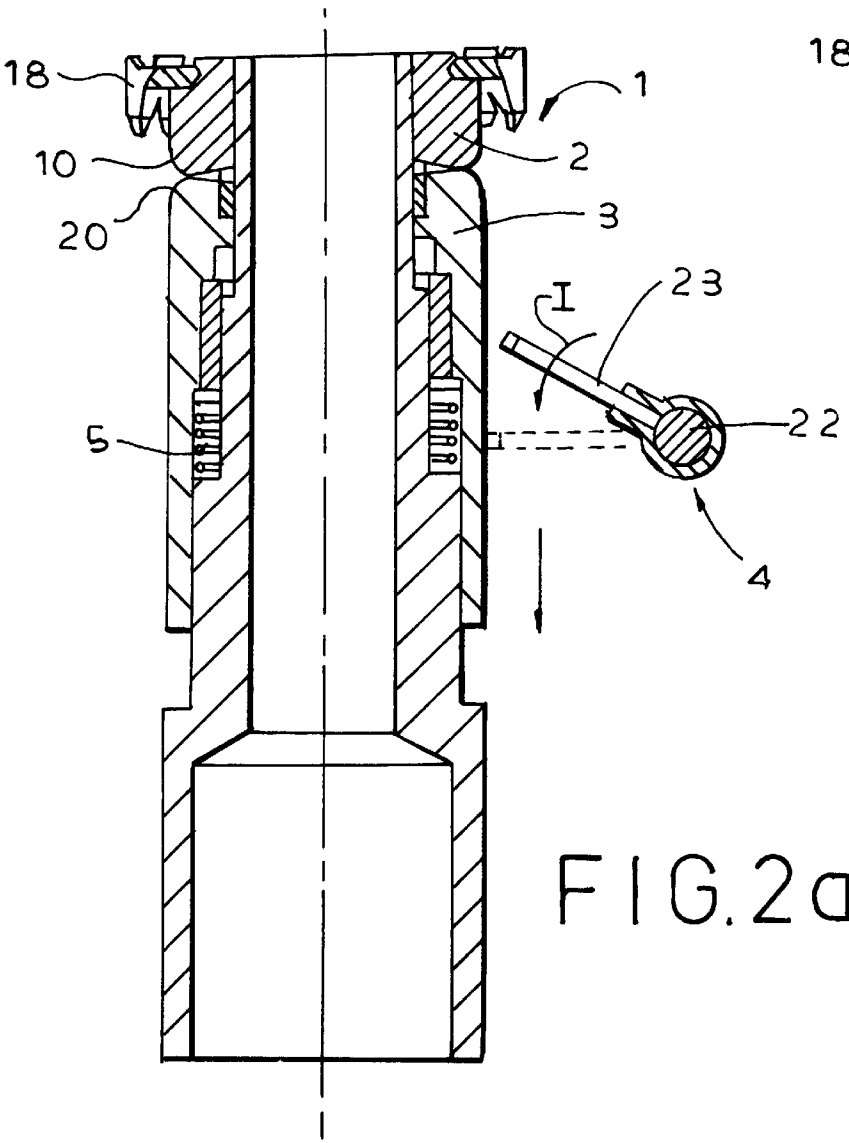
FIG. 2*a* is a longitudinal section through the clamping system of the invention and through an actuatable device used in conjunction therewith.

Upon termination of spinning, the supply of yarn from the drafting frame of the spinning machine, the movement of the ring rail and the spindle speed are so correlated that an underwinding thread 15, represented diagrammatically in FIG. 2*b*, loops around the spindle 1 by less than one complete turn, i.e. by less than 360°. This partial turn of the underwinding thread passes into the inwardly converging slit between the collar 2 and the clamping sleeve 3 and is there engaged, being held by the force of the spring 5 until the doffing of the bobbin is complete.

With the doffing of the bobbin, the thread leading to the clamped portion of the underwinding engages on the new bobbin sleeve and conventional bobbin winding can proceed. The clamp is disengaged to free the thread 15.

To release the end, the shaft 22 is rotated in its counter clockwise sense (arrow I) to bring the clamping sleeve 3 to standstill or to brake it and thereby reduce its speed.

The wave shaped contours ride on one another to displace the sleeve 3 downwardly against the force of the spring 5 and thereby free the underwinding thread which previously was clamped between the sleeve 3 and the collar 2. With centrifugal force applied to the spindle, the underwinding thread is released and incorporated into the bobbin.

Figure 3B:
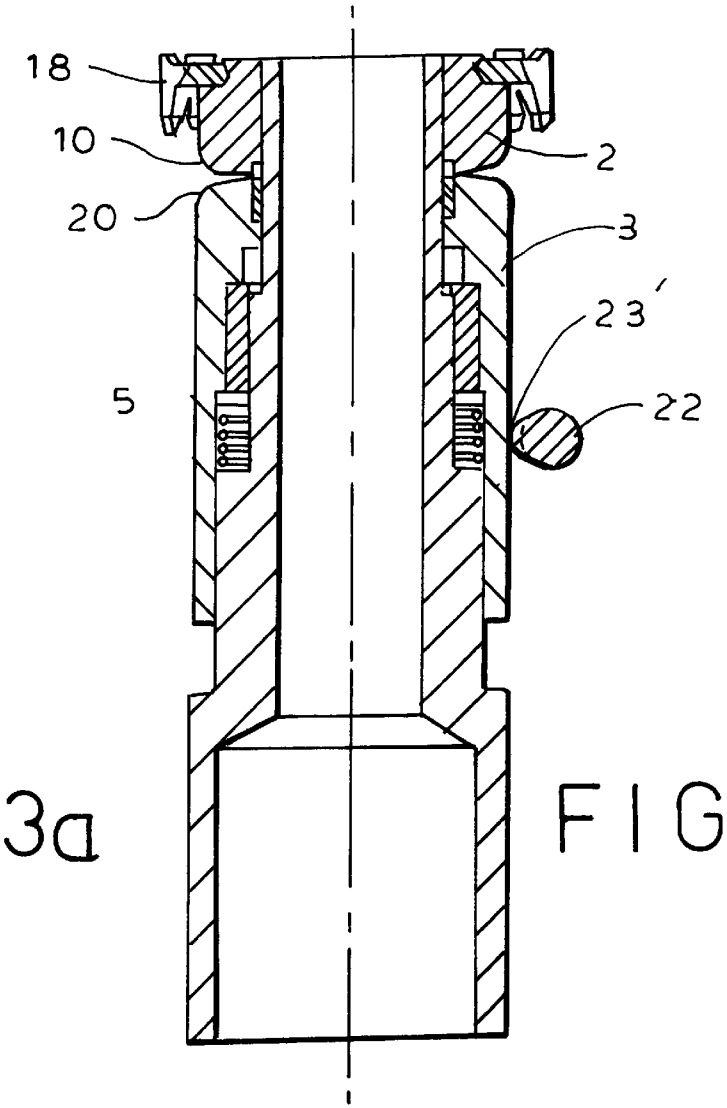
FIG. 3*b* is a section of the clamp in an embodiment analogous to that of FIG. 3*a* but with the parts in a position freeing the underwinding thread.
Figure 3A:
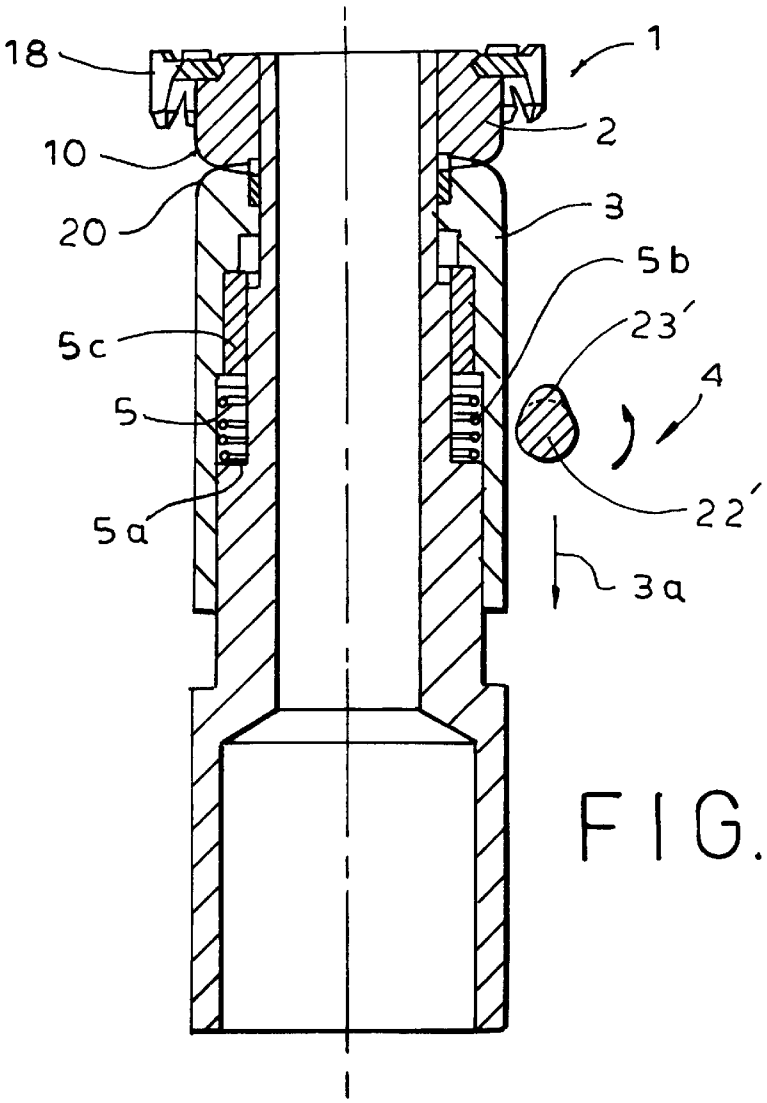
FIG. 3*a* is a longitudinal section through another embodiment of a clamp showing the parts in their clamping position.

In the embodiment of FIGS. 3*a* and 3*b*, the actuating mechanism 4 has a cam 23' and a shaft 22'. FIG. 3*a* shows the clamping position, i.e. the position in which the end faces 10 and 20 are in close fitting engagement with one another and the clamping sleeve 8 is held in its upper position against the collar 2 by a force of spring 5. The latter can be a coil compression spring. The spring 5 is braced between a shoulder 5*a* on the whorl 18*c* of the spindle and a shoulder 5*b* of a sleeve 5*c* press-fitted into the clamping sleeve 3. The underwinding thread is engaged between the end faces 10 and 20.

Figure 4:
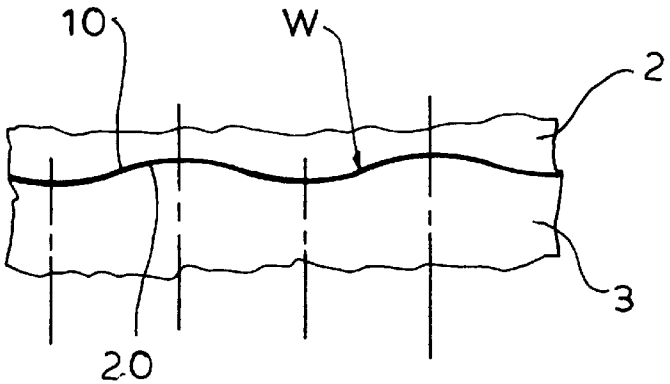
FIG. 4 is an unwound view illustrating the wave-shaped contour.

If the shaft 22' is rotated in the counterclockwise sense from its position illustrated in FIG. 3*a*, the cam 23' will frictionally engage the sleeve 3 and retard the rotation thereof relative to the collar 10 which continues to rotate with the spindle. As a result of the wavy configuration (see FIG. 4) of the mutually engaging surfaces, the collar 2 and the sleeve 3 are cammed apart axially (arrow 3*a*) and a separation is provided between the collar and the sleeve sufficient to release the clamped underwinding thread.

The simultaneous braking or shutdown of all of the spindles by the braking of their clamping sleeves 3 provides a considerable load on the drive of the spinning machine and to eliminate such overloading of the drive, the actuating elements 23 and 23' can be stepped with respect to the angles relative to one another so that braking of the sleeves 3 is effected sequentially from spindle to spindle. The shaft 22' is rotated. The braking of the clamping sleeves 3 and the bringing of the spindles to standstill can thus be effected one after the other along the row of spindles.

FIG. 5 also shows the wave contour of the shoulder 2 and the axially movable sleeve can have a wave contour W.

Figure 6B:
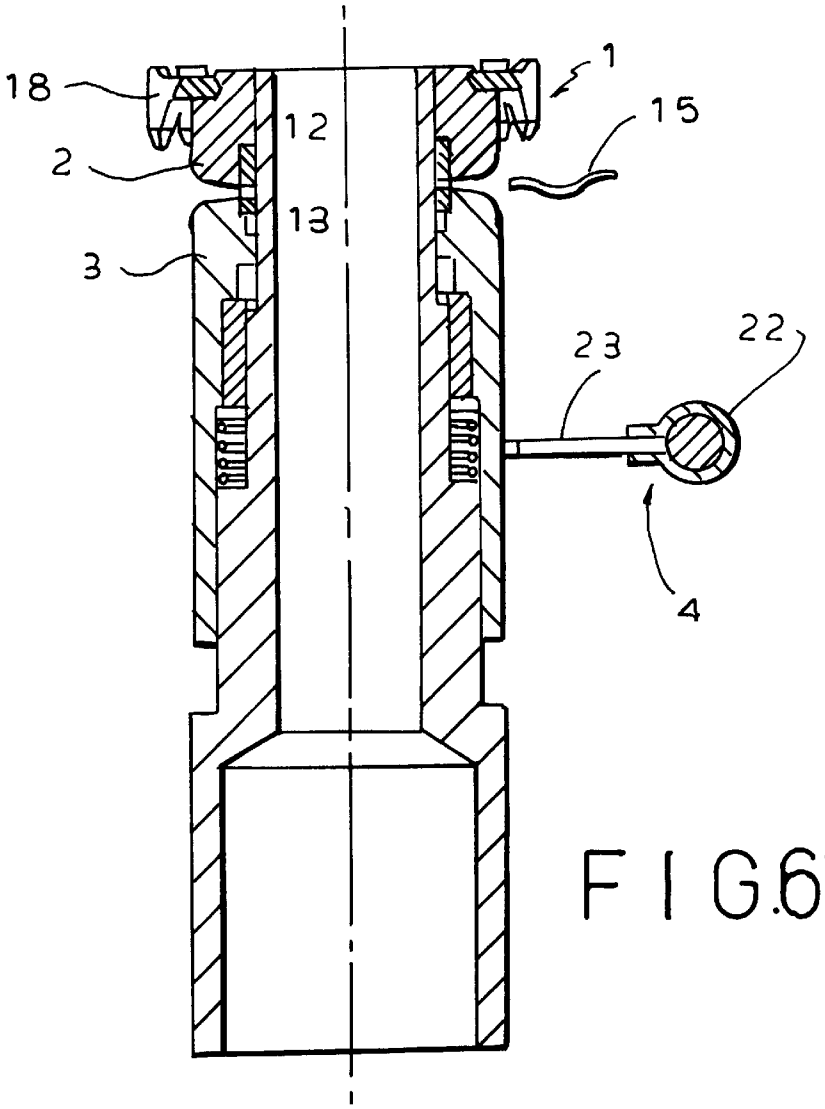
FIG. 6*b* is a longitudinal section similar to FIG. 6*a* but showing the parts in their thread-releasing position.
Figure 6A:
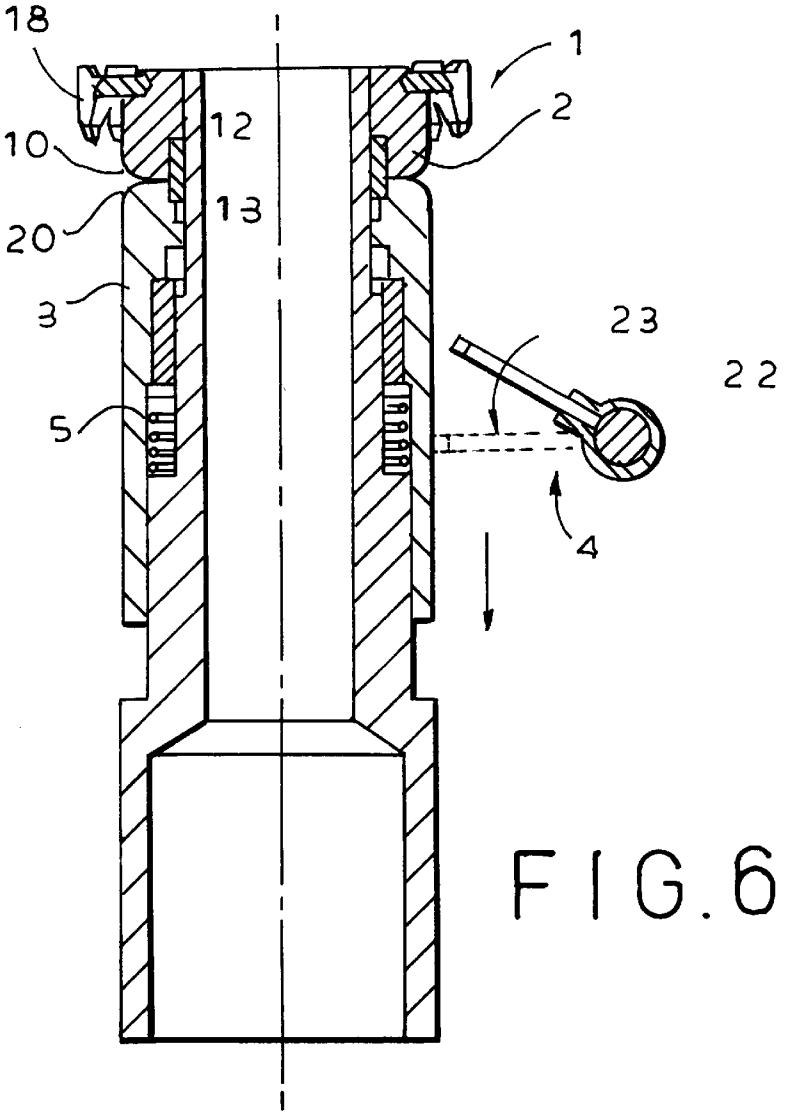
FIG. 6*a* is a longitudinal section through a clamping unit according to another embodiment of the invention and through its actuating member.
Figure 6C:
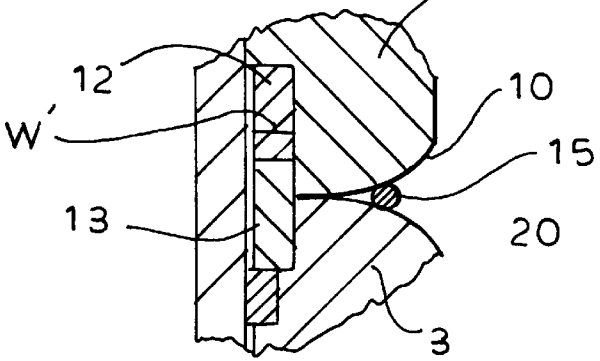
FIG. 6*c* is an enlarged detail of the region VIc—VIc of FIG. 6*a;*

FIGS. 6*a*–6*c* show an embodiment in which the wave shape contours W' are provided in two rings 12 and 13 which are seated in the corresponding end faces 10 and 20 of the collar 2 and the clamping sleeve 3 along their inner peripheries. In this case, the thread is not engaged by the wave-shaped formations but rather, as shown for the thread 15 in FIG. 6*c*, between two convex surfaces which define an inwardly converging crevice between them. When the sleeve 3 is braked relative to the spindle and the collar 2, the ring 13 and with it the sleeve 3 can be cammed downwardly to release the underwinding thread 15. A clamping unit 4 for this purpose includes an arm 23 on the shaft 22 which is engageable with the outer periphery of the sleeve 3 (FIG. 3*a*).

Figure 7:
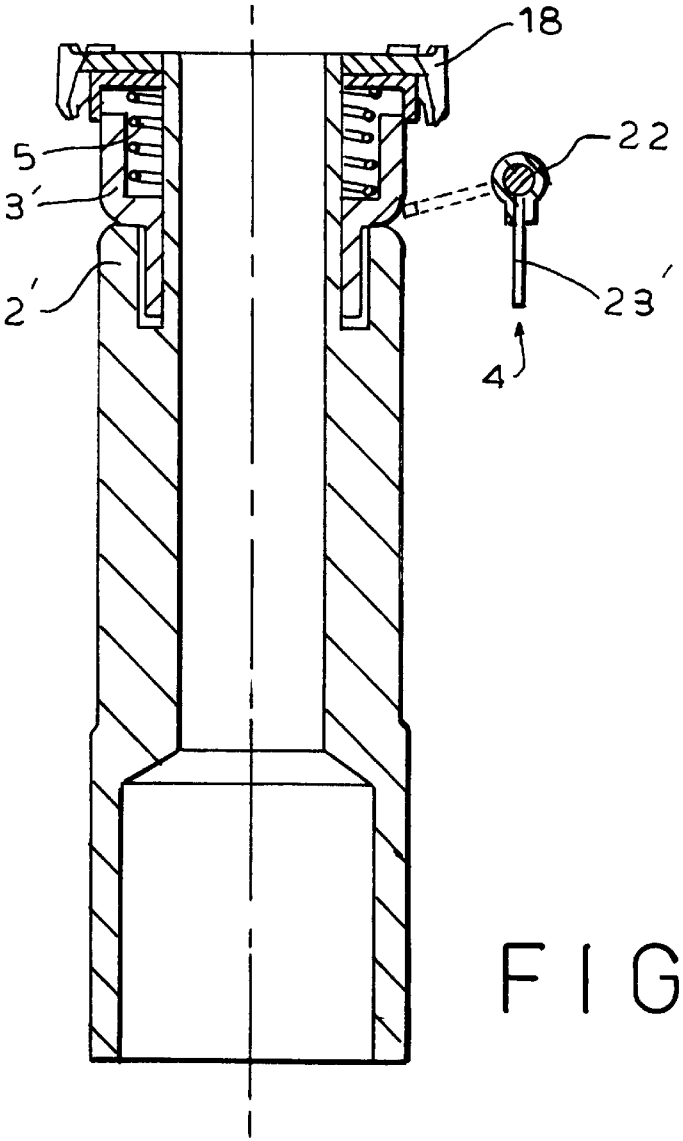
FIG. 7 is an axial section through a variant.

The kinematic reversal of the structure shown may also be employed and in this case, the collar 2' may be fixed on the whorl of the spindle below the sleeve 3' and with the braking of the axially shiftable sleeve 3' by the arm 23' on the shaft 22, the end faces of the collar 2' and the sleeve 3' which engage an underwinding thread between them under the forces of the spring 5 can release this underwinding thread (FIG. 7). In this case the sleeve 3' is cammed upwardly.

Figure 8A:
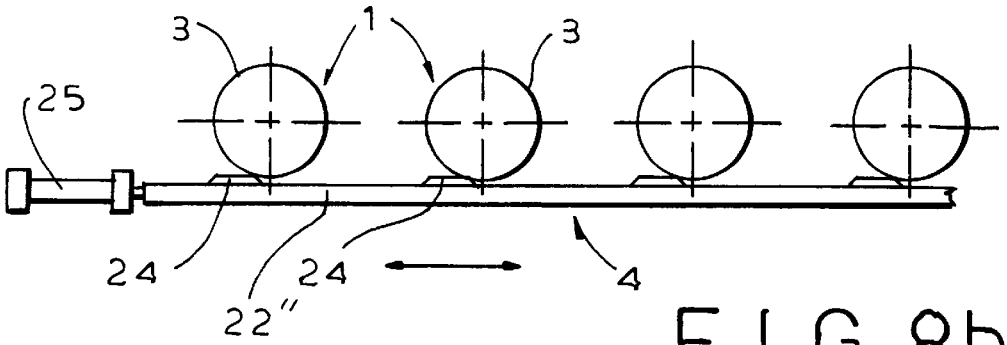
FIG. 8*a* is a plan view of the actuating system in a clamping position.
Figure 8B:
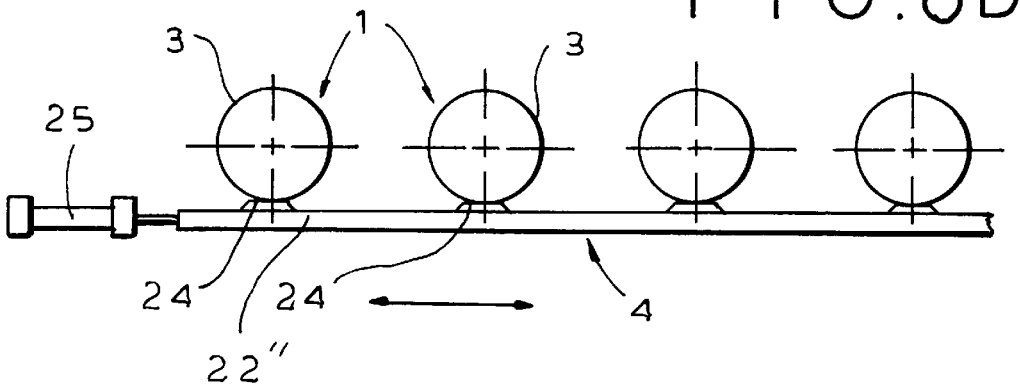
FIG. 8*b* is a view similar to FIG. 8*a* with the parts in the liberating position.

FIGS. 8*a* and 8*b* show an actuating device 4 which includes a horizontal bar 22" which can be longitudinally shifted by actuator 25 so that its actuating elements 24, for example wear-resistant brake pads, can engage the peripheries of the clamping sleeves 3. FIG. 8*b* shows the engagement position in which the sleeves are retarded and hence the underwinding threads are released while FIG. 8*a* shows the clamping position in which the underwinding threads are engaged between the clamping sleeve and the collar.

Figure 9A:
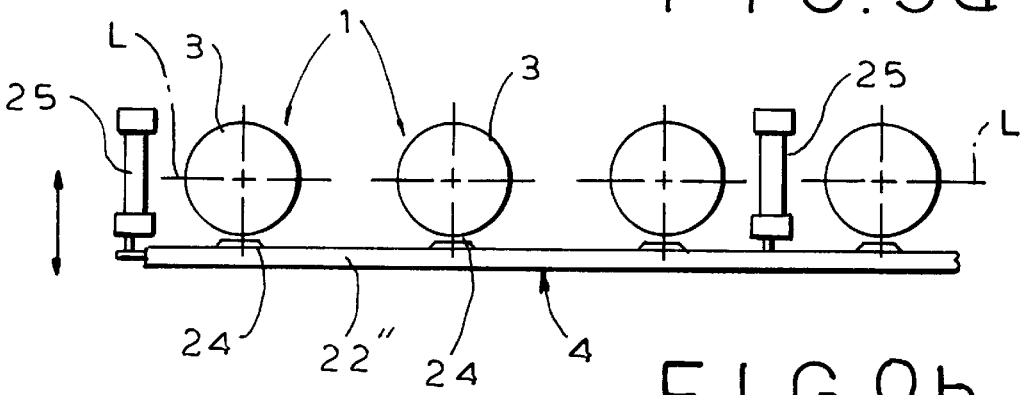
FIG. 9*a* is a plan view showing another embodiment of the actuator in the clamping position.
Figure 9B:
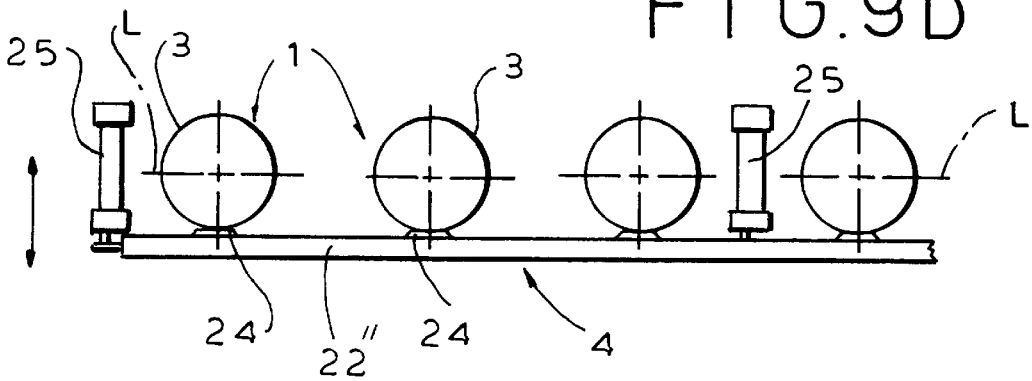
FIG. 9*b* is a view of the apparatus of FIG. 9*a* showing the release position.

FIGS. 9*a* and 9*b* illustrate an embodiment in which again a horizontal bar 22" carrying brake pads 24 serves as the actuator and is displaced by linear effectors 25 which can be solenoid-type electromagnetic effectors or hydraulic or pneumatic cylinders. FIG. 9*a* shows the clamping position in which the sleeves 3 are free to rotate while FIG. 9*b* shows the brake position in which the underwinding thread is released.

Figure 10:
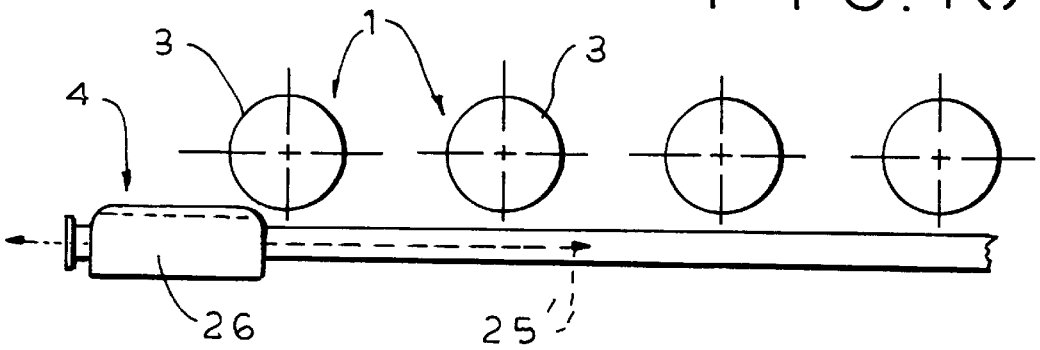
FIG. 10 is a plan view in diagrammatic form of an actuating unit adapted to move along the rows of spindles.
Figure 11:
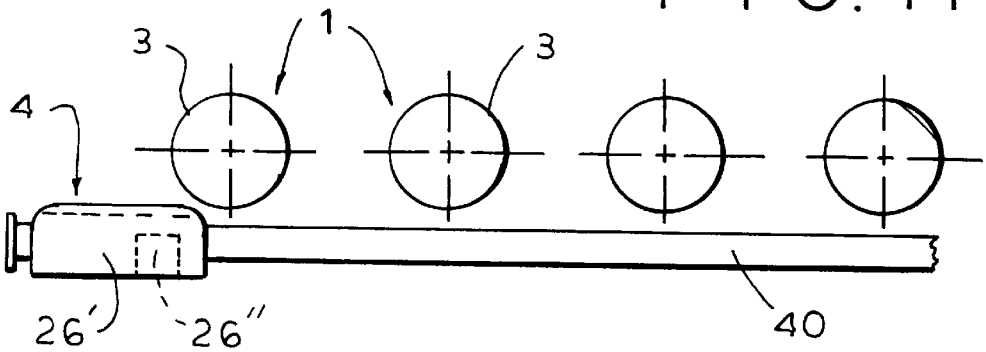
FIG. 11 is a view similar to FIG. 10 in which a self propelled actuator is provided.

FIG. 10 shows still another actuating unit 4 utilizing an actuating element 26 which is propelled along the row of spindles and hence of sleeves 3 to successively brake the latter. The propulsion force may be supplied by a tractive element 25' such as a cable, belt or the like. In this embodiment, of course, the underwinding thread clamps are released in succession along the row of spindles. Another similarly operating actuator 4 has a sleeve propelled braking element 26' driven along a rail 40 with an electric motor drive operated by a storage battery 26" in the carriage 26'. Alternatively, the motor of the carriage 26' may be supplied with the current form a show or wiper engaging a contact strip along the rail 40.

Figure 12:
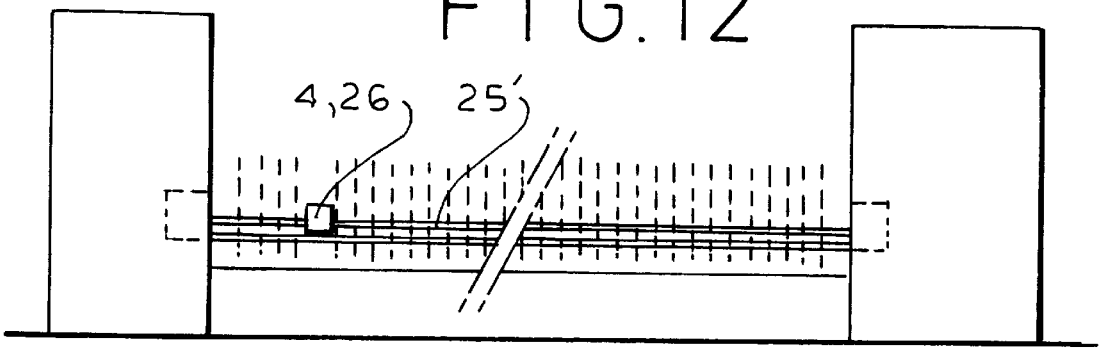
FIG. 12 is a diagrammatic elevational view of a ring spinning machine having the actuator of the invention.
Figure 13:
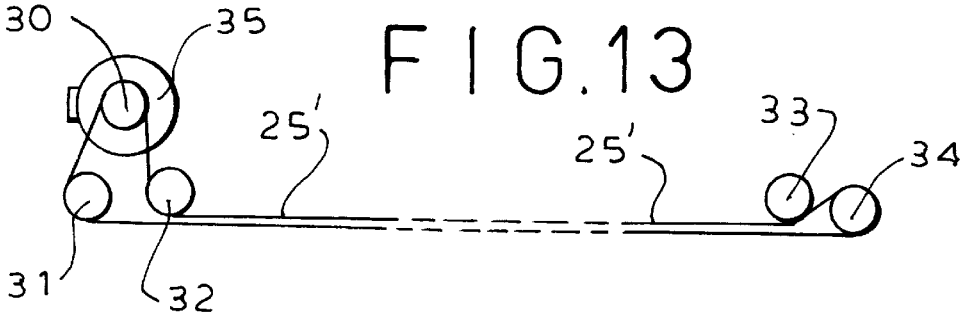
FIG. 13 is a schematic elevational view showing the belt for driving the actuator in elevation.

FIG. 12 has an actuating carriage 26 displaceable by a tractive element 25' in the form of an endless belt drive. The latter, represented at 25' can be seen in plan view in FIG. 13 and has at least one drive pulley 30 connected with a drive motor 35 and passes around guide rollers 31–34. The carriage 26 is connected with one of the passes of the belt 25 and which is driven back and forth along the spindle row to successively engage the clamping sleeve 3 in the manner previously described.

We claim:

1. An underwinding thread clamp for a rotatable spindle of a ring-spinning machine or a ring-twisting machine and wherein said spindle is adapted to receive a yarn package which can be withdrawn from said spindle, said underwinding thread clamp comprising:

a collar member on said spindle below said yarn package;

a clamping sleeve member on said spindle axially juxtaposed with said collar member, said collar and clamping sleeve member clamping an underwinding thread between them following completion of winding of the yarn package and looping of the underwinding thread through less than 360° below said yarn package, said clamping sleeve member being rotatable on said spindle and at least one of said collar and clamping sleeve members being axially shiftable on said spindle, said collar & clamping sleeve members having mutually juxtaposed surfaces with complementary and interfitting wave-shaped contour means for axially camming said collar & clamping sleeve members apart to release said underthread upon rotational braking of said clamping sleeve member relative to said spindle; and an actuatable device having braking means shiftable into engagement with said clamping sleeve member for braking rotation thereof relative to said collar member to effect camming of said members apart.

2. The underwinding-thread clamp defined in claim 1 wherein on said machine a multiplicity of said spindles is provided in a row, each of said spindles is provided with a respective one of said underwinding-thread clamps, and said actuatable device is constructed and arranged to engage and brake a plurality of said clamping sleeve members of a respective plurality of the clamps.

3. The underwinding-thread clamp defined in claim 2 wherein said wave-shaped contour means are provided over an entire periphery or over a total diameter of mutually juxtaposed end faces of said collar & clamping members.

4. The underwinding-thread clamp defined in claim 3 wherein said end faces are substantially parallel to one another in cross section.

5. The underwinding-thread clamp defined in claim 3 wherein said end faces are convex and concave toward one another in cross section.

6. The underwinding-thread clamp defined in claim 3 wherein each of said end faces has an inner ring and each inner ring has an end surface provided with the wave-shaped contour means.

7. The underwinding-thread clamp defined in claim 3 wherein said actuatable device comprises a respective actuating element at each spindle movable against the respective clamping sleeve member.

8. The underwinding-thread clamp defined in claim 7 wherein said actuating elements are all swingable together about a common horizontal axis.

9. The underwinding-thread clamp defined in claim 7 wherein said actuating elements are all shiftable together along the row of spindles.

10. The underwinding-thread clamp defined in claim 7 wherein successive ones of said actuating elements are offset from one another angularly or in an actuation direction along the row of spindles.

11. The underwinding-thread clamp defined in claim 7 wherein all of the actuating elements are shiftable in common toward the spindles.

12. The underwinding-thread clamp defined in claim 3 wherein said actuatable device includes an actuating element movable along the row of spindles.

13. The underwinding-thread clamp defined in claim 12 wherein said actuatable device includes a drive means coupled to said element and running along said row.

14. The underwinding-thread clamp defined in claim 13 wherein said drive means includes a belt.

15. The underwinding-thread clamp defined in claim 13 wherein said drive means is a self-powered member movable along said row of spindle.

16. The underwinding-thread clamp defined in claim 13 wherein said actuatable device is mounted on a cleaning unit movable along a row of spindles of the machine.

* * * * *